United States Patent [19]

Everett

[11] 4,248,125

[45] Feb. 3, 1981

[54] SUPPORT FOR VIOLIN OR SIMILAR STRING INSTRUMENT

[76] Inventor: Charles H. Everett, 2502 Kimberly Dr., Toledo, Ohio 43615

[21] Appl. No.: 21,453

[22] Filed: Mar. 19, 1979

[51] Int. Cl.[3] ..... G10D 3/18
[52] U.S. Cl. ..... 84/280; 84/278
[58] Field of Search ..... 84/278, 279, 280, 327

[56] References Cited

U.S. PATENT DOCUMENTS

| | | | |
|---|---|---|---|
| 1,721,919 | 7/1929 | Meyers | 84/280 R |
| 1,971,552 | 8/1934 | Fisher | 84/280 R |
| 2,057,825 | 10/1936 | Hardy | 84/280 R |
| 2,483,052 | 9/1949 | Humphrey | 84/280 |
| 3,727,509 | 4/1973 | Henkle | 84/280 R |

FOREIGN PATENT DOCUMENTS

| | | | |
|---|---|---|---|
| 1326 | of 1901 | United Kingdom | 84/280 C |
| 744673 | 2/1956 | United Kingdom | 84/279 |

*Primary Examiner*—Lawrence R. Franklin
*Attorney, Agent, or Firm*—Wilson, Fraser, Barker & Clemens

[57] ABSTRACT

A shoulder support for a violin or similar string instrument secures to the periphery of the instrument by clamping on an axis generally aligned with the peripheral vertical edge, i.e., the rib, of the instrument. The support comprises a mounting device which clamps to the instrument and a padded rest which may be readily assembled to and disassembled from the mounting device. The position and orientation of the padded rest is adjustable relative to the mounting device and body of the string instrument. The mounting device may also include means for mounting a conventional chin rest on the upper portion of the instrument.

11 Claims, 11 Drawing Figures

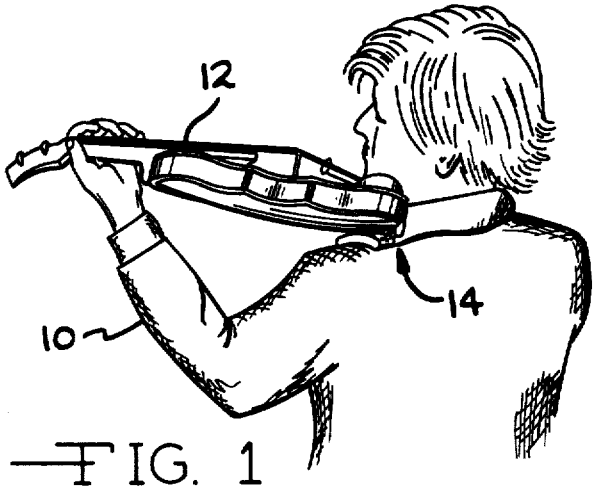
FIG. 1
FIG. 5
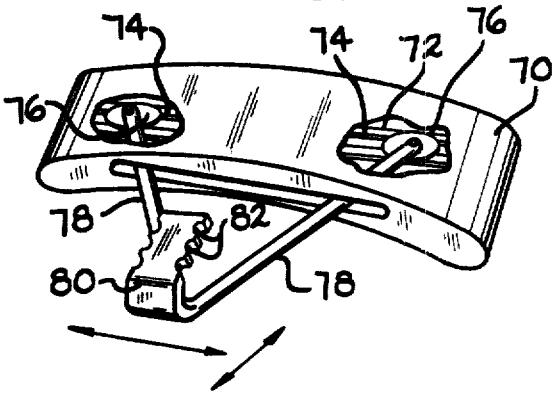
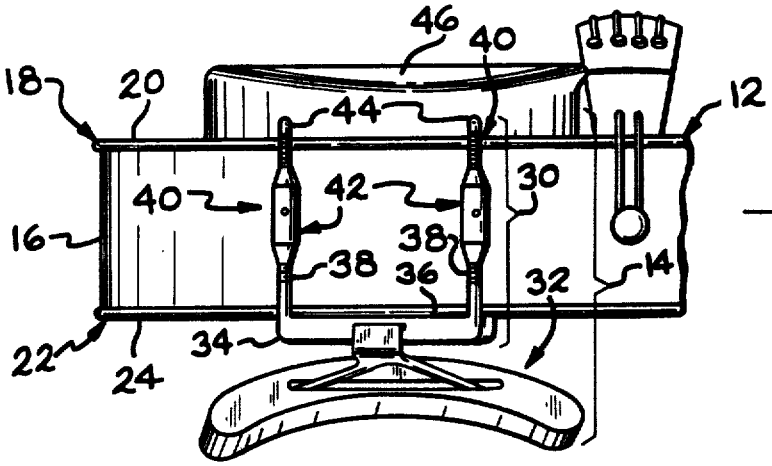
FIG. 2
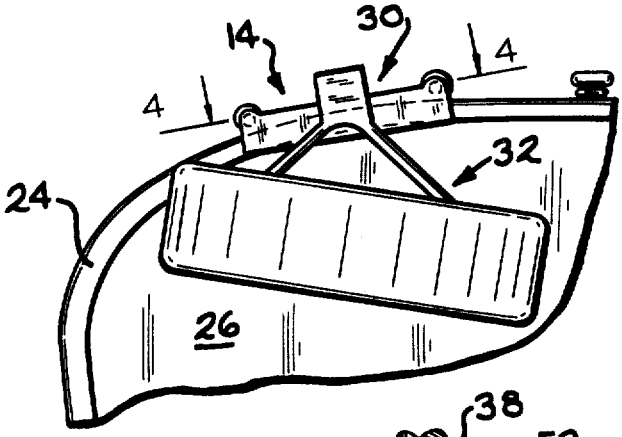
FIG. 3
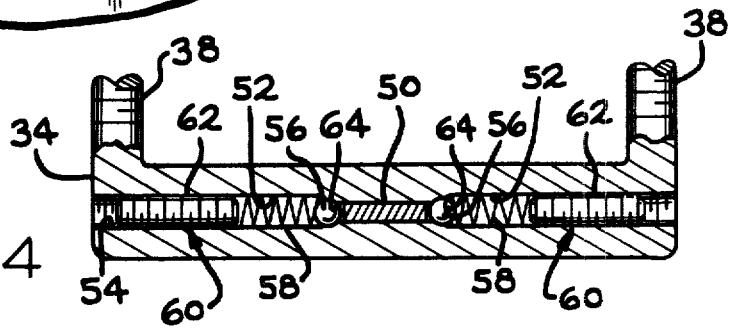
FIG. 4

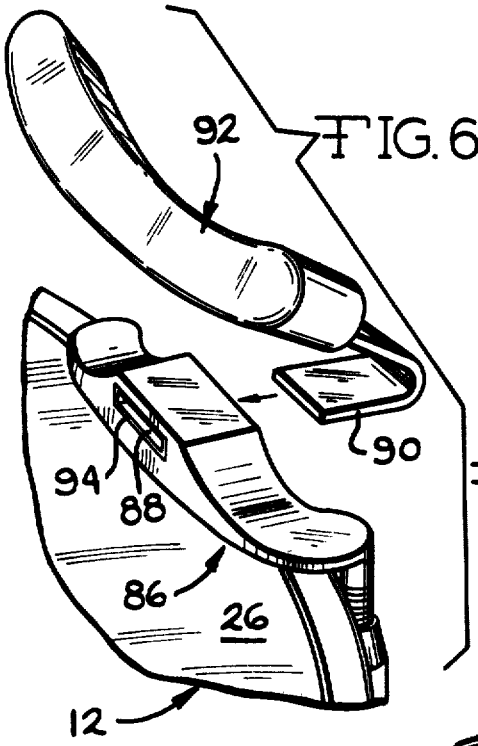
FIG. 6
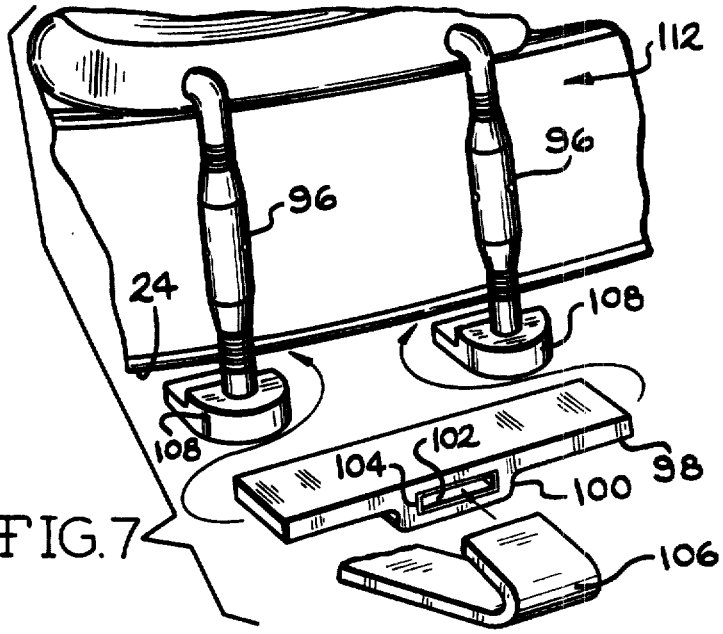
FIG. 7
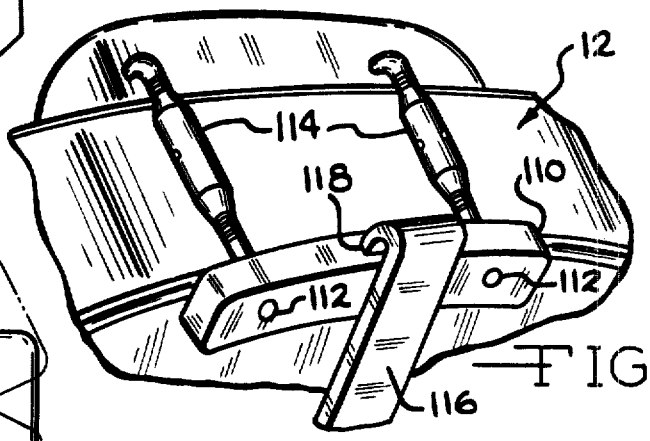
FIG. 8
FIG. 9
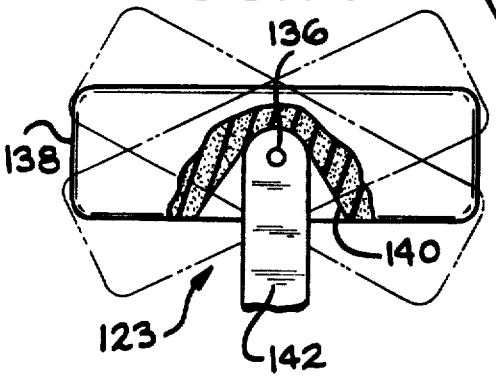
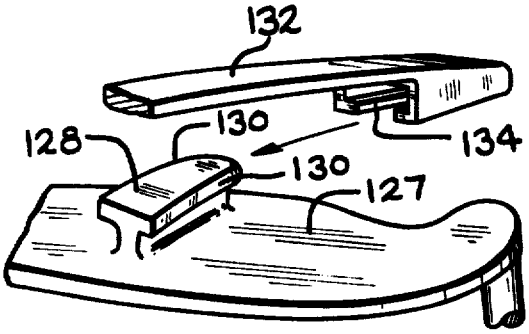
FIG. 11
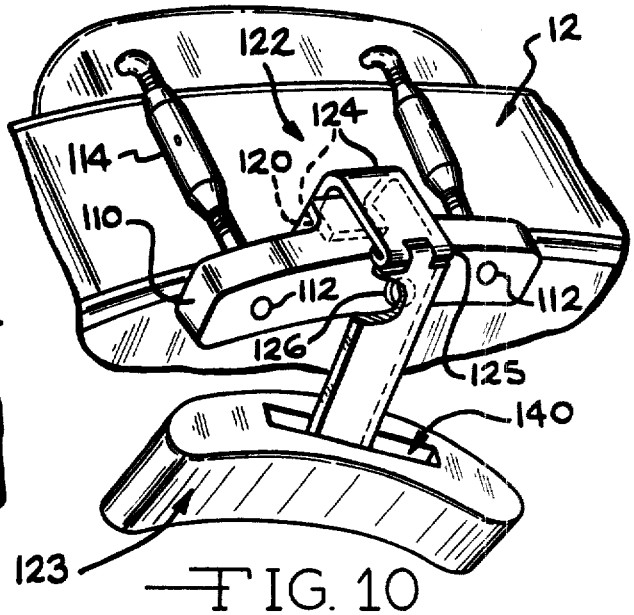
FIG. 10

SUPPORT FOR VIOLIN OR SIMILAR STRING INSTRUMENT

BACKGROUND OF THE INVENTION

The invention relates generally to musical instruments and more specifically to a means for supporting a violin, viola or similar musical instrument upon the shoulder of a performer.

It is well known that the sound produced solely by the vibrating strings of a violin, viola or similar string instrument is all but inaudible. The strings depend upon the body of the instrument and the resonant cavity which it defines for augmentation. The body, especially the top plate and back plate, the cavity defined thereby and the F-hole openings in the top plate resonate at various points across the frequency spectrum of the instrument to provide this augmentation. It is thus apparent that the entire body of the instrument is intimately related to the overall loudness and quality of the sound.

Logically then, an instrument which has a portion of its top plate or bottom plate damped to prevent vibration will not generate the optimum sound which either it or the performer is capable of. Unfortunately, such damping routinely results from positioning the instrument against the shoulder and neck of the performer in order to play the instrument. To accomodate a violin under the chin of the performer, a chin rest is routinely secured parallel to the top plate of the violin. Such a device is commonly clamped to the vertical peripheral edge or rib of the instrument—a mounting arrangement which has generally been found to have a negligible affect on the sound produced by the instrument.

Means for supporting the instrument on the shoulder of the performer involve more difficult problems which have not been as easily solved. Differences as obvious as physical size and as subtle as personal style dictate that any such shoulder support should be adjustable. Numerous United States patents, including U.S. Pat. Nos. 755,977, 904,258, 1,431,077 1,971,552 and 3,683,098 are directed to such adjustable supports. However, the failure of these patented devices to gain wide acceptance indicates that such prior art devices are not without shortcomings. Bulk, adjustments which provide freedom of movement along unintended as well as intended lines of action and unnecessary complexity often prompted this lack of acceptance.

Instead of utilizing such devices, many violinists simply rest the instrument on their shoulder and place a handkerchief or other pad therebetween. Such an approach has obvious disadvantages; correct placement of the pad, dislodging of the pad and the generally unaesthetic appearance, to name but three. From a musical standpoint, however, a far more serious problem exists inasmuch as a portion of the back plate of the instrument is in contact with the pad or shoulder of the performer and will be damped—quantitatively and qualitatively interfering with the sound of the instrument.

SUMMARY OF THE INVENTION

The instant invention comprehends a shoulder support for a violin or similar string instrument. The support generally comprises a mounting device which secures to the periphery of the instrument by clamping on an axis parallel to the rib of the instrument and a pad assembly which rests on the performer's shoulder and removably attaches to the mounting device. The mounting device is semi-permanently attached to the violin by threaded, turnbuckle-like mounts which exert a clamping and securing force on the violin along a line of action generally coincident with the rib of the violin. As such, the mounting device, when affixed to the instrument has a negligible affect on the resonance of the body and the sound produced by the instrument. The mounting device includes a socket assembly which removably receives a mating arm or lug of the shoulder pad. The mounting device may include a detent device such as a spring biased ball bearing or may merely receive and retain the lug by frictional engagement. A resilient liner within the socket may also be utilized if desired.

The shoulder pad is fabricated of any appropriately resilient material and may be shaped to conform generally to the shoulder and/or collar bone of a performer. The pad may also incorporate a swivel or extensible interconnection between the pad and the arm or lug to facilitate positive adjustment of the shoulder pad. The support device thus positions the instrument slightly above rather than on the shoulder of the performer and the sound of the instrument is thus improved.

It is therefore an object of the instant invention to provide a device for supporting a violin or similar string instrument on the shoulder of a performer.

It is a further object of the instant invention to provide a string instrument shoulder support which is attached to the instrument without either defacing it or adversely affecting its sound.

It is a still further object of the instant invention to provide a string instrument support having a shoulder pad which is easily and rapidly attachable and removable from a mounting device, semi-permanently attached to the instrument.

Further objects and advantages of the instant invention will be apparent by reference to the following drawings and description of the preferred embodiment.

BRIEF DESCRIPTION OF THE DRAWINGS

FIG. 1 is a perspective view of a violinist holding a violin having a support according to the instant invention attached thereto;

FIG. 2 is an end elevational view of a shoulder support according to the instant invention in place upon a violin;

FIG. 3 is a bottom plan view of a shoulder support according to the instant invention in place upon a violin;

FIG. 4 is a full sectional elevational view of the mounting device taken along line 4—4 of FIG. 3;

FIG. 5 is a fragmentary perspective view of the shoulder pad of the instant invention;

FIG. 6 is a perspective view of a first alternate embodiment of a violin shoulder pad according to the instant invention;

FIG. 7 is a perspective view of a second alternate embodiment of a violin shoulder support according to the instant invention;

FIG. 8 is a perspective view of a third alternate embodiment of a violin shoulder support according to the instant invention;

FIG. 9 is a fragmentary elevational view of a first alternate embodiment of a shoulder pad according to the instant invention;

FIG. 10 is a perspective view of a fourth alternate embodiment of a violin shoulder support according to the instant invention; and FIG. 11 is a perspective view of a fifth alternate embodiment of a violin shoulder support according to the instant invention.

DESCRIPTION OF THE PREFERRED EMBODIMENT

Referring now to FIG. 1, a violinist is generally designated by the reference numeral 10 and is illustrated holding a violin 12 to which a shoulder support assembly 14 has been secured. Throughout the following Description, reference will be made to use of the shoulder support assembly 14 with the violin 12. However, it should be apparent that this reference is illustrative only and that the support assembly 14 may be equally readily utilized with violas or similar string instruments.

In FIGS. 2 and 3, the shoulder support assembly 14 is shown mounted upon the violin 12. The violin 12 includes a vertical peripheral edge or rib 16 disposed between an upper and lower bead 18 and 22, respectively, each bead having a peripheral flat surface 20 and 24, respectively, oriented perpendicularly to the rib 16. A bottom or back plate 26 completes the lower portion of the violin 12 and a similar top plate (not shown) completes the upper portion of the violin 12. The shoulder support assembly 14 includes a mounting assembly 30 and a pad assembly 32. The mounting assembly 30 includes an elongate bracket 34 having a generally planar surface 36 and two spaced apart studs 38 oriented perpendicularly to the planar surface 36. Each of the studs 38 forms a portion of two turnbuckle-like assemblies 40 which further include a centrally disposed collar 42 and two additional studs 44. All of the studs 38 and 44 and the internal portions of the collars 42 include mating male and female threads. According to conventional turnbuckle design, one stud of each turnbuckle-like assembly 40 and the corresponding engagable portion of the collar 42 defines right-handed threads while the opposite stud of each turnbuckle assembly 40 and the corresponding other engagable portion of the collar 42 defines left-handed threads. Thus, in conventional fashion, rotation of the collars 42 relative to the studs 38 and 44 increases or decreases the overall length of the turnbuckle-like assemblies 40. The studs 44 preferably terminate in a chin rest 46. The chin rest 46 is a contoured block which rests against the flat surface 20 of the bead 18 and provides the gently sloping concave surface against which the chin of the violinist 10 may rest.

Referring now to FIG. 4, the bracket 34 includes a transversely extending through slot 50 which receives the pad assembly 32. The bracket 34 as well as the other components of the shoulder support may be fabricated of a metal exhibiting appropriate strength and machinability properties such as steel, brass or aluminum. Disposed generally axially within the bracket 34 and intersecting the through slot 50 is a circular passageway 52 having female threads 54 disposed along at least a portion of its length. The passageway 52 provides a mounting means for two spring biased detent assemblies which each comprises a ball bearing member 56, a compression spring 58 and a set screw 60 having male threads 62 complementary to the female threads 54 disposed within the passageway 52. The points of intersection between the through slot 50 and the passageway 52 are defined by two openings 64 having dimensions somewhat smaller than the diameter of the bearings 56 in order that they be retained within the passageway 52. The set screws 60, the compression springs 58 and the ball bearings 56 thus form two opposed spring biased detenting mechanisms on opposite sidewalls of the through slot 50 in the bracket 34.

Referring now to FIG. 5, the shoulder pad assembly 32 includes a contoured resilient pad 70 fabricated of an appropriate padding material and may be covered with a durable outer layer of fabric or leather if desired. Disposed generally centrally within the pad 70 is a plate 72 which provides general shape and support to the pad 70 as well as a positive attachment location for two pivoting, extensible arms 78. The arms 78 may be secured to the plate 72 by one of several known conventional means which provide limited linear sliding engagement between these components. For example, the plate 72 may define a slotted opening 74 which slidably receives two bushings 76 secured to the ends of the arms 78. The bushings 76 have an outer diameter substantially greater than the width of the slotted opening 74 and an inner, core diameter substantially less than such width and thus provide adjustment of both the effective length of the arms 78 as well as their lateral position relative to the pad 70. Alternatively, the plate 72 may define a slotted opening 74 which receives a single bushing 76 disposed on one arm 78, the other arm 78 being pivotally secured to the plate 72 at a fixed point. At the end of the arms 78 opposite the pad 70, they merge to form a U-shaped bracket 80. The U-shaped bracket 80 includes pairs of detenting recesses 82 disposed along opposite edges of the U-shaped bracket 80. Although three pairs of detenting recesses 72 are illustrated in FIG. 5, it should be apparent that the number of recesses and the length of the portion of the U-shaped bracket 80 containing them may be substantially extended to provide a greater range of adjustment of the pad assembly 32.

Brief reference to FIG. 2 will clarify the utilization of the shoulder support assembly 14. The mounting assembly 30 is first attached to the periphery of the violin 12 by tightening the bracket 34 and the chin rest 46 against the upper and lower surfaces 20 and 24, respectively, by rotating the turnbuckle assemblies 40. It should be noted that due to the small size of the bracket 34, the entire mounting assembly 30 may be left semi-permanently attached to the violin 12 without, in most instances, interfering with the storage or transportation of the violin. In use, the U-shaped bracket 80 is aligned with and inserted into the through slot 50 of the bracket 34 and positioned with the desired pair of detenting recesses 82 adjacent the ball bearings 56 and the detent mechanism. It should be noted that the spring constant of the compression spring 58 as well as the position of the set screws 60 within the passageway 52 may be modified or adjusted to regulate the amount of detenting force which retains the U-shaped bracket 80 and pad assembly 32 within the through slot 50 of the mounting assembly 30. Finally, the pair of arms 78 may be adjusted such that the pad 70 of the assembly 14 is appropriately positioned relative to the violinist 10. As is apparent in FIG. 1, the shoulder support assembly 14 of the instant invention maintains the violin 12 at a finite distance above the shoulder of the violinist 10 and thus precludes damping of the back plate 26 of the violin 12 which would otherwise occur if it rested against the shoulder of the violinist 10.

Referring now to FIG. 6, the first alternate embodiment of the shoulder support assembly 14 is illustrated. It includes a mounting device 86 having a transverse through slot 88 which accepts a complementarily shaped bracket 90 which forms a portion of the shoulder pad assembly 92. The through slot 88 may include a resilient linear 94 such as nylon or similar material which provides smooth frictional engagement of the bracket 90 and allows simple adjustment of the relative position between the two assemblies.

FIG. 7 illustrates a second alternate embodiment of the instant invention. This embodiment adapts the invention for use with a Hill chin rest having two independent turnbuckle assemblies 96. A generally elongate flat plate 98 includes a raised central portion 100 having a through slot 102 which may, as in the first alternate embodiment of FIG. 6, include a nylon liner 104 to provide smooth frictional engagement between the slot 102 and a bracket portion 106 of the pad assembly (not shown). The elongate plate 98 is positioned between two overhanging clamp assemblies 108 and the flat surface 24 of the violin proper. The turnbuckle assemblies 96 are then tightened, thereby securing the plate 98 to the violin.

FIG. 8 illustrates a third alternate embodiment of the instant invention wherein the mounting device attached to the violin takes the form of a block 110 having a pair of threaded holes 112 into which threaded studs which form a portion of two turnbuckle assemblies 114 may be secured. In this alternate embodiment, a bracket portion 116 of the shoulder pad assembly (not illustrated) may be secured into a transverse slot 118 of the mounting block 110 by means of either a resilient liner as illustrated in FIGS. 6 and 7 or a detenting mechanism similar to that illustrated in FIG. 4.

A fourth alternate embodiment of a shoulder support assembly according to the instant invention is illustrated in FIG. 10. In this embodiment, which is quite similar to a third alternate embodiment illustrated in FIG. 8, the mounting block 110 includes a slot 120 which is vertically disposed relative to the body of the violin 12 whereas the slot 118 in the third alternate embodiment is horizontally disposed. A hinged arm 122 which is pivotally secured to a shoulder pad assembly 123 includes two right angle or substantially right angle bends 124. A hinge 125 positioned as illustrated in FIG. 10 interconnects sections of the hinged arm 122 and assists assembly of the shoulder pad arm 122 into the mounting block slot 120. Disposed on either the lower surface of the mounting block 110 or the upper surface of the arm 122 where these elements are most proximate is a resilient pad 126. The resilient pad 126 which may be fabricated of any somewhat stiffly resilient material such as rubber provides a stop against which the hinged portion of the arm 122 may rest.

FIG. 11 illustrates a fifth alternate embodiment of the mounting device of the instant invention. Here a bracket 127, similar to that illustrated in FIG. 6, includes a T-shaped structure 128. The T-shaped structure 128 may be secured to the bracket 127 by welding, brazing or other means known in the art. The T-shaped structure 128 defines opposed, non-parallel edges 130 which converge in the direction opposite the arrow in FIG. 11. In this alternate embodiment, the pad assembly includes a flat arm 132 which defines a socket 134 having generally parallel inner surfaces which engage the T-shaped structure 128 on the bracket 127. This alternate embodiment may also include a nylon or similar material liner (not illustrated) within the socket 134.

Referring to FIG. 9, the first alternate embodiment 123 of the pad assembly 32 is illustrated. The alternate embodiment pad assembly 123 comprehends a centrally disposed pivot pin 136 within a formed pad 138 having a narrow, re-entrant slot 140 which permits the pad 138 to be pivoted relative to a bracket or support arm 142. This alternate embodiment 123 comprehends a degree of rotational freedom about the pivot pin 136. It should be understood, however, that a swivel joint (not illustrated) could be substituted for the single pivot pin 136 to provide additional freedom of movement.

The foregoing disclosure is the best mode devised by the inventor for practicing this invention. It is apparent, however, that devices incorporating modifications and variations to the instant invention will be obvious to one skilled in the art of violin and string instrument supports. Inasmuch as the foregoing disclosure is intended to enable one skilled in the pertinent art to practice the instant invention, it should not be construed to be limited thereby but should be construed to include each aforementioned obvious variations and be limited only by the spirit and scope of the following claims.

What I claim is:

1. A shoulder support for a violin and similar string instruments comprising, in combination, shoulder pad means for supporting the violin having an outwardly extending arm, a substantially rigid plate disposed therein and a movable interconnection joining said plate and said arm, said movable interconnection including at least one bushing means for slidably and rotatably interconnecting said plate and said arm, and an elongate mounting member having a pair of spaced apart means for selectively securing said mounting member to a peripheral edge of a string instrument, said mounting member defining an arm receiving aperture, further defining a passageway intersecting said aperture, and including spring biased detent meand disposed within said passageway for frictionally engaging said arm.

2. The string instrument shoulder support of claim 1 wherein said arm includes at least a pair of recesses disposed along opposing edges engagable by said detent means.

3. The string instrument shoulder support of claim 1 wherein said plate defines an elongate slot which receives said bushing means.

4. The string instrument shoulder support of claim 3 wherein said arm is bifurcated and defines two converging arm members extending from said pad, each of said arm members including bushing means for engaging said elongate slot.

5. A shoulder support for a violin or similar string instrument comprising, in combination, a resilient shoulder pad having a plate member disposed generally centrally therein, said plate member defining an elongate slot, an arm member having a first end disposed generally centrally within said shoulder pad and a second end disposed in spaced apart relationship with said pad and defining at least one detent seat, means secured to said first arm end and engaging said elongate slot for slidably interconnecting said arm and said plate member, a clamp base having turnbuckle means for securing said base to the periphery of a string instrument, said base defining an aperture complementarily sized to receive said second end of said arm member and a passageway oriented substantially perpendicularly to and intersecting said aperture, and detent means disposed within said passageway for frictionally engaging said detent seat.

6. The string instrument shoulder support of claim 5 wherein said shoulder pad is arcuate in profile.

7. The string instrument shoulder support of claim 5, wherein said aperture includes a plastic liner disposed about its inner surfaces.

8. The string instrument shoulder support of claim 5 wherein said detent means includes a threaded adjustment screw, a compression spring and a detent member for selective reception within said detent seat.

9. The string instrument shoulder support of claim 5 wherein said arm member first end is bifurcated and includes two spaced apart ends.

10. The string instrument shoulder support of claim 9 wherein each of said spaced apart ends includes means for slidably interconnecting said arm and said plate member.

11. The string instrument shoulder support of claim 5 or claim 10 wherein said means for interconnecting said arm and said plate member includes at least one bushing having a shoulder portion of a diameter greater than the width of said elongate slot.

* * * * *